United States Patent [19]

Quinn et al.

[11] 4,166,012

[45] Aug. 28, 1979

[54] METHOD OF PREPARATION OF ELECTROOPTICAL ELEMENTS

[75] Inventors: Edward J. Quinn, East Amherst, N.Y.; Donald H. Campbell, Niagara-on-the-Lake, Canada

[73] Assignee: Hooker Chemicals & Plastics Corp., Niagara Falls, N.Y.

[21] Appl. No.: 866,424

[22] Filed: Jan. 3, 1978

[51] Int. Cl.[2] ..... B05D 3/10; B05D 1/36; B05D 1/38; B05D 7/04

[52] U.S. Cl. ..... 204/30; 427/108; 427/110; 427/164; 204/38 R

[58] Field of Search ..... 427/108, 109, 110, 322, 427/333, 343, 164; 204/30, 35 R, 38 R

[56] References Cited

U.S. PATENT DOCUMENTS

| | | | |
|---|---|---|---|
| 3,650,708 | 3/1972 | Gallagher | 428/418 X |
| 4,063,004 | 12/1977 | Quinn | 204/30 X |

*Primary Examiner*—James R. Hoffman
*Attorney, Agent, or Firm*—Peter F. Casella; William J. Crossetta, Jr.; Arthur S. Cookfair

[57] ABSTRACT

A process for the preparation of transparent electroconductive coatings on a polymeric substrate comprises:

(A) contacting said substrate with a solution of a phenol compound and a chlorinated aliphatic compound, (B) removing the phenol from the surface of the substrate, (C) subjecting the substrate to phosphorus sesquisulfide to deposit phosphorus sesquisulfide in the surface thereof, (D) contacting the phosphorus sesquisulfide treated surface with a solution of a metal salt or complex thereof to form a metal-phosphorus-sulfur coating thereon.

16 Claims, No Drawings

METHOD OF PREPARATION OF ELECTROOPTICAL ELEMENTS

BACKGROUND OF THE INVENTION

This invention relates to a method for the preparation of transparent electroconductive coatings on a transparent polymeric substrate.

Processes for the formation of conductive coatings on nonconductive substrates such as plastics are well known and used commercially, for example, in the production of low cost plastic articles that have a metal appearance. One such process is disclosed in U.S. Pat. No. 3,650,708, issued Mar. 21, 1972 to W. P. Gallagher. Such processes are commonly used for decorative or other purposes. A wide variety of commercially available opaque and transparent polymeric materials are used for this purpose. Considerable progress has been made with many of the available polymeric materials in producing adherent metal deposits thereon. The coating processes employed generally include a variety of substrate pretreatments including etching steps, and treatments with various conditioners and solvents. Typically, when such processes are applied to a polymeric substrate for decorative purposes, the clarity or transparency of the substrate or of the final plated article is of no consideration. However, for various purposes it is desirable to provide a transparent electroconductive coating on the surface of a clear transparent polymer material without appreciable loss of the clarity or transparency of the substrate. Transparent plastic materials having electroconductive transparent coating thereon are useful for a wide variety of commercial purposes, for example, in the construction of transparent electrodes, electroluminescent devices, liquid crystal display devices, electrooptical devices or materials and the like. Commonly, when known processes for the conductivizing of plastic materials are applied to clear transparent plastic materials, such as acrylates, such as polymethylmethacrylate or polymethylacrylate, or polyethylene terephthalate, the clarity or transparency of the material is adversely effected. Furthermore, although such materials may be conductivized by known techniques, when the materials are in the form of relatively thin substrates such as, sheets, films, or tape, the result of such flexing action frequently results in problems with respect to adherence of the metallic coating.

It is, therefore, an object of the present invention to provide an improved process for the preparation of a transparent electroconductive coating on polymeric substrates. It is a further object of the invention to provide a process for the production of adherent metallic coating on thin, transparent, flexible polymeric substrates such as polymeric films, sheets, tapes or the like. It is further object of the invention to provide a transparent polymeric material having a transparent electroductive coating thereon, suitable for use in the manufacture of electrooptical materials and devices such as transparent electrodes, electroluminescent devices, liquid crystal display devices, and the like.

SUMMARY OF THE INVENTION

This invention provides a process for the preparation of transparent electroconductive coating on a polymeric substrate comprising:

(A) contacting the substrate with a solution of a phenol compound and a chlorinated aliphatic compound;

(B) removing the phenol from the surface of the substrate;

(C) subjecting the substrate to phosphorus sesquisulfide to deposit phosphorus sesquisulfide in the surface thereof;

(D) contacting the phosphorus sesquisulfide treated surface with a solution of a metal salt or complex thereof to form a metal-phosphorus-sulfur coating thereon.

The coated polymeric substrate, prepared in this manner may be further treated, for example, by electroplating, or by application of various further coatings to provide specific properties suitable for various end uses.

Although the process of this invention may be applied to a wide variety of non-electroconductive substrates, such as polymeric materials, it is particularly effective in the treatment of transparent polymeric materials such as acrylic polymers, such as polymethyl methacrylate, and most especially polyesters of the type prepared from terephthalic acid and polyhydric alcohols such as polyethylene terephthalate. The polymeric substrate can be in various physical forms, such as shaped articles, or materials such as sheets, rods, fibers, fabrics, tapes, films, or the like, of various thicknesses. Especially preferred are relatively thin polymeric sheets or films.

DETAILS OF THE PREFERRED EMBODIMENTS

In the first step of the preferred process of the invention, the substrate is pre-treated with a solution of a phenol compound and a chlorinated aliphatic compound. Among the various phenol compounds which may be employed for this purpose are included, for example, phenol, cresol, chlorophenol, bromophenol, catechol, resorcinol, hydroquinone, thymol, phenanthrol, carvacrol, and the like, the preferred being phenol. Among the chlorinated aliphatic compounds suitable for this purpose are included, for example, chloroform, methyl chloroform, dichloroethylene, trichloroethylene, perchloroethylene, trichloroethane, dichloropropane, and the like, the preferred compound being perchloroethylene.

The preferred pre-treatment solution is a phenol-perchloroethylene bath wherein the volume ratio of phenol:perchloroethylene is between about 20:40 and 65:40, and most preferably between about 50:40 and 60:40. The temperature of the liquid is preferably maintained in the range of between about 40° to about 65° Celsius.

Following the pre-treatment with a phenol solution, the phenol is removed from the surface of the substrate in a second pre-treatment step, preferably by contact with a solvent for the phenol compound. Preferred solvents for this purpose are liquid chlorinated aliphatic compounds such as chloroform, methyl chloroform, dichloroethylene, trichloroethylene, perchloroethylene, trichloroethane, dichloropropane, or the like, the preferred compound being perchloroethylene. The temperature of the liquid may vary considerably but is preferably about 35° to about 65° Celsius.

The first and second pre-treatments may be carried out by washing, soaking, dipping, or otherwise contacting the substrate with the liquids described hereinabove. The length of time of the pre-treatments may vary, depending on the nature of the substrate, the temperature employed, and the method of contact, but will typically be in the range of between about 1 second and 1 hour for each pre-treatment. The second pre-treatment, if employed, may be for a shorter time period than the first pre-treatment step. Preferably, the pre-treatments are effected by immersing the polymeric substrate in a bath of the phenol-chlorinated aliphatic compound for a period of about 3 to 8 minutes and subsequently immersing in a bath of the chlorinated aliphatic compound for a period of about 0.5 to about 2.0 minutes.

Following the phenol-solution pre-treatment and prior to the second pre-treatment in a liquid chlorinated aliphatic compound, it is important to minimize the possibility of phenol crystallization on the substrate surface. The crystallization of phenol on the substrate surface may result in a fogginess or decreased transparency of the final coated substrate. To avoid such occurrence it is preferred to minimize air exposure between the first and second pre-treatment steps. Preferably, exposure to air is limited to a period of less than about one minute and, most preferably, to less than about twenty seconds.

Following the pre-treatment steps described, the substrate is treated with phosphorus sesquisulfide dissolved in a suitable solvent, to deposit phosphorus sesquisulfide on or within the surface of the substrate. Suitable solvents which may be employed for this purpose are solvents that dissolve the phosphorus sesquisulfide without detrimentally affecting the surface of the substrate. Such solvents include the halogenated hydrocarbons and halocarbons such as chloroform, methyl chloroform, phenyl chloroform, dichloroethylene, trichloroethylene, perchloroethylene, trichloroethane, dichloropropane, ethyl dibromide, ethyl chlorobromide, propylene dibromide, monochlorobenzene, monochlorotoluene and the like; aromatic hydrocarbons such as benzene, toluene, xylene, ethyl benzene, naphthalene and the like; ketones such as acetone, methyl ethyl ketone, and the like; acetic acid; acetic acid trichloroethylene mixtures; carbon disulfide; and the like.

When a solution of phosphorus sesquisulfide is employed in the process, the solution concentration is generally in the range from about 0.0001 weight percent of phosphorus sesquisulfide based on the weight of the solution up to a saturated solution, and preferably from about 0.1 to about 1.5 percent.

The phosphorus sesquisulfide treatment is generally conducted at a temperature below the softening point of the substrate, and below the boiling point of the solvent. Generally, the temperature is in the range of about 0° to 100° Celsius, but preferably in the range of about 20° to 40° Celsius. The contact time varies depending on the nature of the substrate, the solvent and temperature, but is generally in the range of about 1 second to 1 hour or more, preferably in the range of about 1 to 10 minutes. The substrate may then be rinsed with a solvent, and then can be partially dried by merely exposing the substrate to the atmosphere, or by drying the surface with radiant heaters or in a conventional oven. Drying times can vary considerably, for example, from 1 second to 30 minutes or more, preferably 5 seconds to 10 minutes, more preferably 5 to 120 seconds.

A stabilizer is advantageously employed in the $P_4S_3$ solution. The stabilizer can be a polyhydroxy aromatic compound such as resorcinol, hydroquinone, and the like. Alternatively, the stabilizer can be an alkyl substituted thiourea. Typical polyhydroxy aromatic compounds are resorcinol, hydroquinone, pyrocatechol, dihydroxynaphthalene, benzenetriol, and the like polyhydroxybenzene and polyhydroxynaphthalene compounds. The aromatic compounds can be substituted with alkyl (1 to 5 carbon atoms) groups such as 4-t-butyl pyrocatechol; 4,5-ditertiary butylresorcinol; 2,3,4-trimethylhydroquinone; and the like. The alkyl substituted thioureas contain one to four lower alkyl groups of 1 to 4 carbon atoms. Useful thioureas include methylthiourea; ethylthiourea; N,N'-di-n-butylthiourea; N,N,N'-tripropylthiourea; N,N,N',N'-tetramethylthiourea; N,N'-di-methyl-N',N'-diethylthiourea; and the like. The preferred stabilizer is N,N'-di-n-butylthiourea.

Following the phosphorus sesquisulfide treatment step, the treated substrate is contacted with a solution of a metal salt or a complex of a metal salt, which is capable of reacting with the phosphorus sesquisulfide to form a metal-phosphorus-sulfur coating. The metals generally employed are those of Groups IB, IIB, IVB, VB, VIIB, and VIII of the Periodic Table. The preferred metals are copper, silver, gold, nickel, palladium and the like.

The metal salts that are used in the invention can contain a wide variety of anions. Suitable anions include the anions of mineral acids such as sulfate, chloride, bromide, iodide, fluoride, nitrate, phosphate, chlorate, perchlorate, borate, carbonate, cyanide, and the like. Also useful are the anions of organic acids such as formate, acetate, citrate, butyrate, valerate, caproate, stearate, oleate, palmitate, and the like. Generally, the anions of organic acids contain one to 18 carbon atoms.

Some useful metal salts include copper sulfate, copper chloride, silver nitrate, nickel chloride and nickel sulfate.

The metal salts can be complexed with a complexing agent that produces a solution having the basic pH (7). Ammonical complexes of the metal salts, in which one to six ammonia molecules are complexed with the foregoing metal salts may be used. Typical examples include $NiSO_46NH_3$, $NI(C_2H_2O_2)_26NH_2$, $CuSO_46NH_2$, $CuCl_26NH_2$, $AgNO_26NH_2$, $NiSO_43NH_2$, $CuSO_44NH_3$, $NiCl6NH_2Ni(NO_3)_24NH_3$, and the like. Other useful complexing agents include quinoline, amines and pyridine. Particularly useful are amine complexes such as the mono-(ethylenediamine), bis-(ethylenediamine)-, tris(ethylenediamine)-, bis(1,2-propanediamine)-, and bis(1,3-propanediamine)-complexes of salts such as copper sulfate. Typical pyridine complexes include $NiCl_2(py)_2$ and $CuCl_2(py)_2$ where py is pyridine.

The foregoing metal salts and their complexes are used in ionic media, preferably in aqueous solutions. However, other media may be employed such as alcohols, for example, methyl alcohol, ethyl alcohol, butyl alcohol, heptyl alcohol, decyl alcohol and the like. Mixtures of alcohol and water can be used. Also useful are mixtures of alcohol with other miscible solvents of the types disclosed hereinbefore. The solution concentration is generally in the range from about 0.1 weight percent metal salt or complex based on the total weight of the solution up to a saturated solution, preferably from about 0.1 to about 2.0 weight percent metal salt or complex. The pH of the metal salt or complex solution can range from about 4 to 14, but is generally maintained in the basic range, i.e., greater than 7, and preferably from about 10 to about 13.

The step of contacting the phosphorus sesquisulfide treated substrate with the solution of metal salt is generally conducted at a temperature below the softening point of the substrate, and below the boiling point of the solvent, if one is used. Generally, the temperature is in the range of 30° to 100° Celsius, preferably from about 50° to 70° Celsius. The time of contact can vary considerably, depending on the nature of the substrate, the characteristics of the metal salts employed and the contact temperature. However, the time of contact is generally in the range of about 0.1 to 30 minutes, preferably about 3 to 7 minutes.

The treated conductive substrate of the invention can be electroplated by the processes known in the art. Suitable metals, solutions and conditions for electroplating are described in "Metal Finishing Guidebook & Directory" for 1974, published by Metals and Plastics Publications, Inc., Westwood, New Jersey.

The process of the invention may be carried out in such a manner as to prepare a transparent polymeric film, sheet or the like having a transparent electroconductive coating on both sides or, if desired, on only one side. When such materials are desired, having a transparent electroconductive coating on only one side, this may be accomplished in various ways. For example, the coating may be applied to both sides, and subsequently removed from one side by treatment with a suitable solvent, such as nitric acid or the like. Alternatively, the process of the invention may be applied to only one side of the substrate material by careful application of A, C, or D treatment step, such as by spraying, brushing, rolling, padding, or the like without total immersion of the substrate material in the treatment liquids. In another method, one side of the material may be covered during the process with a suitable material, such as a coating, tape or the like which may be subsequently removed by peeling, dissolving or other method.

The following specific examples are provided to further illustrate this invention and the manner in which it may be carried out. It will be understood, however, that the specific details given in the examples have been chosen for purpose of illustration and are not to be construed as a limitation on the invention. In the examples, unless otherwise indicated, all parts and percentages are by weight and all temperatures are in degrees Celsius.

EXAMPLE 1

A sample of polyethylene terephthalate film having a thickness of about 5 mils was treated by immersion for a period of 5 minutes in a bath of 60% by volume phenol and 40% perchloroethylene, maintained at about 58° C. The sample was then removed and immersed for a period of 1 minute in a bath of perchloroethylene maintained at a temperature of about 60° C.

The film was removed from the perchloroethylene rinse and immersed in a bath of perchloroethylene containing in solution 1% by weight $P_4S_3$ and about 0.03% by weight N,N'-dibutylthiourea stabilizer maintained at a temperature of about 35° C. for a period of about 5 minutes. The film was removed and air-exposed at about 21° C. for about 1.25 minutes and then immersed for about one minute in a water bath containing 3% by volume perchloroethylene and 2% by volume of a commercially available surfactant blend (KAMAR PER, an 80% liquid blend of anionic and non-ionic surfactants, an emulsifier for perchloroethylene, Finetex Co., N.J.) maintained at about 60° C. The film was removed and rinsed with tap water for about one minute at about 30° C. then rinsed in a distilled water spray at ambient temperature for about 10 seconds. The sample was then immersed for seven minutes in an aqueous copper sulfate bath maintained at about 63° C. The composition of the aqueous copper sulfate bath was as follows: 0.04 Molar $CuSO_4$; 0.16 Molar ethylenediamine; and 0.40 Molar NaOH. Thereafter the sample was treated by immersion for 15 seconds in a bath of water maintained at about 30° C., then immersed in 3% sulfuric acid at ambient temperature for about 30 seconds and then rinsed in water at about 30° C. for about 15 seconds. The treated sample was then air-dried for about 10 minutes at about 60° C.

The film was treated with nitric acid on one face to remove the coating therefrom. The resultant material was a transparent polyethylene terephthalate film having an electroconductive coating of excellent appearance and transparency on one surface thereof. Mean electrical resistance of the coating was 10,000 ohms per square.

EXAMPLE 2

A transparent polyethylene terephthalate film coated with a transparent acrylic coating was treated substantially as described in Example 1 except that the first pre-treatment (phenol-perchloroethylene bath) was maintained at about 48° C. and the subsequent perchloroethylene rinse was maintained at about 50° C. and the final nitric acid stripping step was omitted to provide a transparent film having a transparent electroconductive coating on both sides. The final processed film had a mean electrical resistance of 22,500±14,000 ohms per square on each face and was of excellent appearance and transparency.

The transparent electroconductive films prepared in the foregoing manner may further be treated in a known manner, such as by electroplating or other method for example to provide further electroconductive coating or other specific coatings for various purposes. Such further treatment may be applied in a known manner to provide a metal coating that is sufficiently thin that transparency of the material is maintained. Alternatively, various other coatings such as ferromagnetic coatings may be applied for various end purposes. Noble metal coatings may be applied to the polymeric substrate by subjecting the metal-phosphorus-sulfur coating to solutions of noble metal salts such as gold chloride and palladium chloride.

What is claimed is:

1. A process for the preparation of transparent electroconductive coatings on a polymeric substrate comprises the steps of:
   (A) contacting said substrate with a liquid solution of a phenolic compound and a chlorinated aliphatic compound;
   (B) removing the phenolic compound from the surface of the substrate;
   (C) subjecting the substrate to phosphorus sesquisulfide to deposit phosphorus sesquisulfide in the surface thereof;
   (D) contacting the phosphorus sesquisulfide treated surface with a solution of a metal salt or complex thereof to form a metal-phosphorus-sulfur coating thereon, wherein the metal is selected from the groups IB, IIB, IVB, VB, VIB, VIIB and VIII of the Periodic Table.

2. A process according to claim 1 wherein step (A) comprises contacting the substrate with a solution of a phenolic compound and a chlorinated aliphatic compound wherein the volume ratio of phenolic compound:chlorinated aliphatic compound is between about 20:40 and about 65:40.

3. A process according to claim 2 wherein step (B) comprises contacting the substrate with a chlorinated aliphatic compound that is a solvent for the phenolic compound of step (A).

4. A process according to claim 3 wherein the solution of step (A) is maintained at a temperature of about 40° to about 65° Celsius.

5. A process according to claim 4 wherein the phenolic compound is phenol.

6. A process according to claim 5 wherein the chlorinated aliphatic compound of step (A) is perchloroethylene.

7. A process according to claim 6 wherein the chlorinated aliphatic compound of step (B) is perchloroethylene.

8. A process according to claim 7 wherein the perchloroethylene of step (B) is maintained at a temperature of about 35° to about 65° Celsius.

9. A process according to claim 7 wherein step (C) comprises contacting the substrate with a solution of about 0.1 to about 1.5 weight percent of phosphorus sesquisulfide, based on the weight of solution.

10. A process according to claim 9 wherein the metal salt or complex is a copper salt.

11. A process according to claim 9 wherein the polymeric substrate comprises polyethylene terephthalate.

12. A process according to claim 11 wherein the polyethylene terephthalate substrate having a metal-phosphorus-sulfur coating thereon is thereafter subjected to electrolytic plating to deposit a ferromagnetic coating thereon.

13. A process according to claim 9 wherein the polymeric substrate is polyethylene terephthalate having a coating of an acrylate polymer on at least a portion of the surface thereof.

14. A process according to claim 9 wherein the polymeric substrate having a metal-phosphorus-sulfur coating thereon is thereafter subjected to a noble metal salt solution to effect deposition of the noble metal thereon.

15. A process according to claim 9 wherein the polymeric substrate having a metal-phosphorus-sulfur coating thereon is thereafter subjected to electrolytic plating.

16. A process for the preparation of a transparent electroductive polyethylene terephthalate material comprising the steps of:

(A) contacting a polyethylene terephthalate film with a solution of phenol and perchloroethylene maintained at a temperature of about 40° to about 65° C., for a period of about three to about eight minutes, the volume ratio of phenol:perchloroethylene in the solution being between about 20:40 to about 65:40;

(B) removing phenol from the surface of the film by contacting with perchloroethylene solvent at a temperature of about 35° to about 65° Celsius for a period of about 0.5 to about 2.0 minutes;

(C) subjecting the film surface to solution of about 0.1 to about 1.5 weight percent of phosphorus sesquisulfide in perchloroethylene for a period of about one minute to about ten minutes at a temperature of about 20° to about 40° Celsius to deposit phosphorus sesquisulfide at the surface; and (D) subjecting the phosphorus sesquisulfide treated surface to a solution of a metal salt or complex thereof at a temperature of about 30° C. to about 70° C. for a period of about 3 to about 7 minutes, to form a metal-phosphorus-sulfur coating thereon, the solution comprising about 0.1 to about 2.0 weight percent of metal salt or complex thereof and having a pH of about 10-13, said metal being selected from the groups IB, IIB, IVB, VB, VIB, VIIB and VIII of the Periodic Table.

* * * * *